US010077528B2

(12) United States Patent
Yoichi et al.

(10) Patent No.: US 10,077,528 B2
(45) Date of Patent: Sep. 18, 2018

(54) CLOTHES DRYER

(71) Applicant: SAMSUNG ELECTRONICS CO., LTD., Suwon-si, Gyeonggi-do (KR)

(72) Inventors: Matsunobu Yoichi, Kanagawa (JP); Okuno Tomoyuki, Kanagawa (JP); Urai Yasushi, Kanagawa (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 193 days.

(21) Appl. No.: 14/791,710

(22) Filed: Jul. 6, 2015

(65) Prior Publication Data

US 2016/0153136 A1 Jun. 2, 2016

(30) Foreign Application Priority Data

Nov. 28, 2014 (JP) ..... 2014-241961
Apr. 20, 2015 (KR) ..... 10-2015-0055122

(51) Int. Cl.
*D06F 58/22* (2006.01)

(52) U.S. Cl.
CPC ..... *D06F 58/22* (2013.01)

(58) Field of Classification Search
USPC ..... 34/72, 79, 82, 85, 104, 105, 595–610; 68/5 C, 5 R, 19, 20
See application file for complete search history.

(56) References Cited

U.S. PATENT DOCUMENTS 4,162,148 A * 7/1979 Furstenberg ..... B01D 45/12 141/256
7,805,856 B2 * 10/2010 Gassmann et al. ..... D06F 58/22 34/300
7,984,568 B2 * 7/2011 Dittmer ..... D06F 58/24 165/186
8,256,136 B2 * 9/2012 Bae ..... D06F 58/203 34/407
8,438,750 B2 * 5/2013 Dittmer ..... D06F 58/22 134/10

(Continued)

FOREIGN PATENT DOCUMENTS

CN 102884244 1/2013
EP 3 026 169 A1 * 6/2016 ..... D06F 58/22
JP 2013-128531 7/2013

(Continued)

OTHER PUBLICATIONS

Machin Translation of JP 2013135789.*

(Continued)

*Primary Examiner* — Stephen M Gravini
(74) *Attorney, Agent, or Firm* — Staas & Halsey LLP

(57) ABSTRACT

A clothes dryer having a lint collecting device for collecting lint is disclosed. The clothes dryer includes: a drum; a duct through which drying air discharged from the drum flows; and a lint removing device disposed in a path of the duct to filter lint contained in the air, wherein the lint removing device includes a cylindrical lint filter of which a part of an outer surface is open, a screw having a spiral blade rotatably provided in an axial direction of the lint filter, a contact rib formed at an opening of the lint filter, and an elastic member configured to protrude to an outside of the blade to be in contact with an inner surface of the lint filter and the contact rib.

26 Claims, 18 Drawing Sheets

(56) References Cited

U.S. PATENT DOCUMENTS

| | | | | |
|---|---|---|---|---|
| 8,667,705 | B2 * | 3/2014 | Shin | D06F 58/22 34/595 |
| 2016/0153136 | A1 * | 6/2016 | Yoichi | D06F 58/22 34/82 |

FOREIGN PATENT DOCUMENTS

| | | |
|---|---|---|
| JP | 2013-135789 | 7/2013 |
| JP | 2013-236695 | 11/2013 |
| KR | 10-2012-0037552 | 4/2012 |

OTHER PUBLICATIONS

Extended European Search Report dated Apr. 8, 2016 in European Patent Application No. 15179349.4.
Chinese Office Action dated May 25, 2017 in corresponding Chinese Patent Application No. 201510736473.2.
European Communication under Rule 71(3) EPC dated Jun. 30, 2017 in corresponding European Patent Application No. 15 179 349.4.
Chinese Notice of Allowance dated Jan. 17, 2018, in corresponding Chinese Patent Application No. 201510736473.2, 5 pgs.

* cited by examiner

CLOTHES DRYER

CROSS-REFERENCE TO RELATED APPLICATIONS

This application claims the benefit of Korean Patent Application No. 10-2015-0055122, filed on Apr. 20, 2015 in the Korean Intellectual Property Office and JP-2014-241961, filed on Nov. 28, 2014 in the Japan Patent Office, the disclosure of which is incorporated herein by reference.

BACKGROUND

1. Field

Embodiments of the present disclosure relate to a clothes dryer, and more particularly, to a clothes dryer having a lint collecting device for collecting lint.

2. Description of the Related Art

In a conventional clothes dryer, lint (pieces of thread) is included in air discharged from a drum. Therefore, a filter is installed in the middle of an air passage, and the lint attached on the filter is removed by a lint removing device.

In general, the conventional clothes dryer is configured so that the lint is attached on an inner circumferential surface of the filter having a semi-cylindrical mesh part, and the lint is scraped off by the lint removing device having a spiral screw which is in contact with an inner surface of the mesh part. The lint scraped off by the screw is moved in a direction of a rotating axis of the lint removing device, and transferred to a lint receiving area.

In the conventional clothes dryer, the scraped off lint may be caught on an outer edge of a screw blade, and may continuously remain around a rotating circumference of the screw blade. In this case, the lint may be interposed between the filter and the screw, and thus may not be transferred and collected.

SUMMARY

Therefore, it is an aspect of the present disclosure to provide a clothes dryer which is capable of preventing lint from being interposed between a filter and a screw.

Also, it is another aspect of the present disclosure to provide a clothes dryer which is capable of surely collecting the lint and reducing a clogging due to the lint Additional aspects of the disclosure will be set forth in part in the description which follows and, in part, will be obvious from the description, or may be learned by practice of the disclosure.

In accordance with an aspect of the present disclosure, a clothes dryer includes a drum; a duct through which drying air discharged from the drum flows; and a lint removing device disposed in a path of the duct to filter lint contained in the air, wherein the lint removing device includes a cylindrical lint filter of which a part of an outer surface is open, a screw having a spiral blade rotatably provided in an axial direction of the lint filter, a contact rib formed at an opening of the lint filter, and an elastic member configured to protrude to an outside of the blade to be in contact with an inner surface of the lint filter and the contact rib.

The contact rib may be disposed at a corresponding position to be in contact with a circumference of the inner surface of the lint filter.

The lint removing device may include a frame member provided to install the lint filter, and the frame member may include an air introduction part, a lint processing part and a lint drawing part.

The lint filter may include a mesh filter, and a filter frame configured to extend in a circumferential direction of the lint filter to support the mesh filter.

The filter frame may include a frame beam part configured to extend in an axial direction of the lint filter, and a plurality of frame parts vertically disposed from the frame beam part.

The frame part may be installed to be inclined in the axial direction of the lint filter.

The elastic member may include one of a rubber material, a resin material and a brush.

An installation part for installing the elastic member may be formed at an outer edge of the blade.

The installation part may include a groove or a protrusion.

The lint filter may have a circumferential length R and a length R' of the opening, and the length R' of the opening may be $R'/R=1/4$.

An angle $\theta$[°] of the blade connected outward from a rotating shaft of the screw may be $45<\theta<70$.

A rotational speed Rs [rpm] of the screw may be $20<Rs<25$.

The clothes dryer may further include a screw motor configured to rotate the screw, and a controller configured to control a rotating motion of the screw motor.

The controller may change a rotation motion of the screw motor so that a reverse rotation motion in which the lint is conveyed from a downstream side of the axial direction of the lint filter toward an upstream side thereof is performed for a predetermined period of time, and then a forward rotation motion in which the lint is conveyed from the upstream side toward the downstream side is performed.

In accordance with another aspect of the present disclosure, a lint removing device disposed in a path of the duct to filter lint contained in the air includes a member comprising an air introduction part, a lint processing part and a lint drawing part; a lint filter disposed at the lint processing part and having a cylindrical shape of which a part of an outer surface is open; a screw having a spiral blade rotatably provided in the lint filter; a contact rib formed at an opening of the lint filter in an axial direction; and an elastic member configured to protrude to an outside of the blade to be in contact with an inner surface of the lint filter and the contact rib.

The lint filter may include a mesh filter, and a filter frame configured to extend in a circumferential direction of the lint filter to support the mesh filter.

The filter frame may include a frame beam part configured to extend in an axial direction of the lint filter, and a plurality of frame parts vertically disposed from the frame beam part.

The frame part may be installed to be inclined in the axial direction of the lint filter.

The elastic member may include one of a rubber material, a resin material and a brush.

An installation part for installing the elastic member may be formed at an outer edge of the blade.

In accordance with an aspect of the present disclosure, a lint removing device that removes lint from air flowing out from an exhaust vent of a clothes dryer may include a frame member, a screw formed lengthwise in the frame member and including a rotating shaft, a blade, and an elastic member installed at an outer edge of the blade, a cylindrically shaped lint filter having an inner diameter to act as a collecting surface for the lint and wherein a predetermined gap is formed between the inner diameter of the lint filter and an outer diameter of the blade. The elastic member may be installed on the blade to protrude radially into the gap to thereby maintain contact with the inner diameter of the lint filter.

In accordance with an aspect of the present disclosure, a lint removing device that removes lint from air flowing out from an exhaust vent of a clothes dryer may include a frame member, a lint filter having a cylindrical shape of which a part of an outer surface is open a screw formed lengthwise in the frame member and disposed within the lint filter, the screw including a rotating shaft, a blade having a spiral shape, and an elastic member installed at an outer edge of the blade. The elastic member may be configured to maintain contact with an inner circumference of the lint filter.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments of the present disclosure will be described with reference to the accompanying drawings. Also, the following description of the embodiment is merely exemplary in nature, and is not intended to limit its application or use. Furthermore, a direction such as up, down, left and right depends on an arrow illustrated in FIG. 1.

<Overall Structure of a Clothes Dryer>

Figure 1:
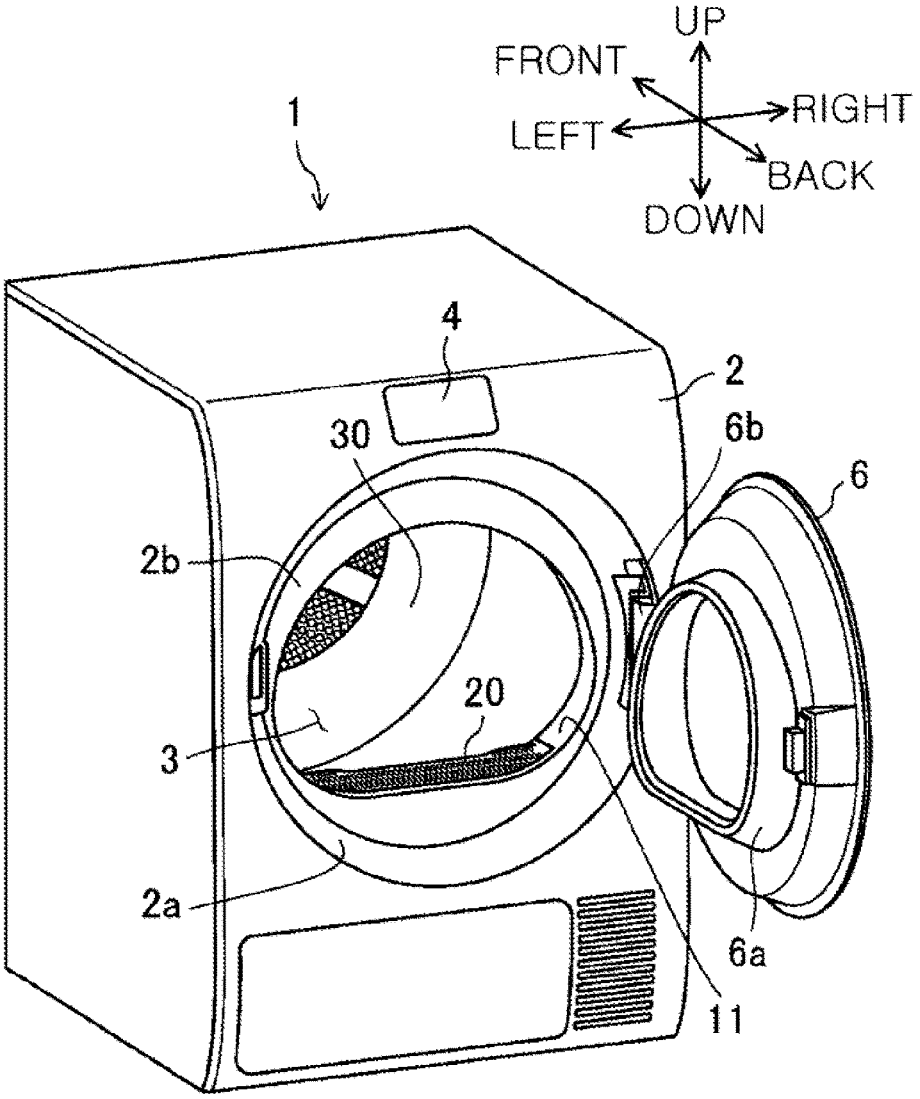
FIG. 1 is a schematic perspective view illustrating an exterior of a clothes dryer according to one embodiment of the present disclosure.
Figure 2:
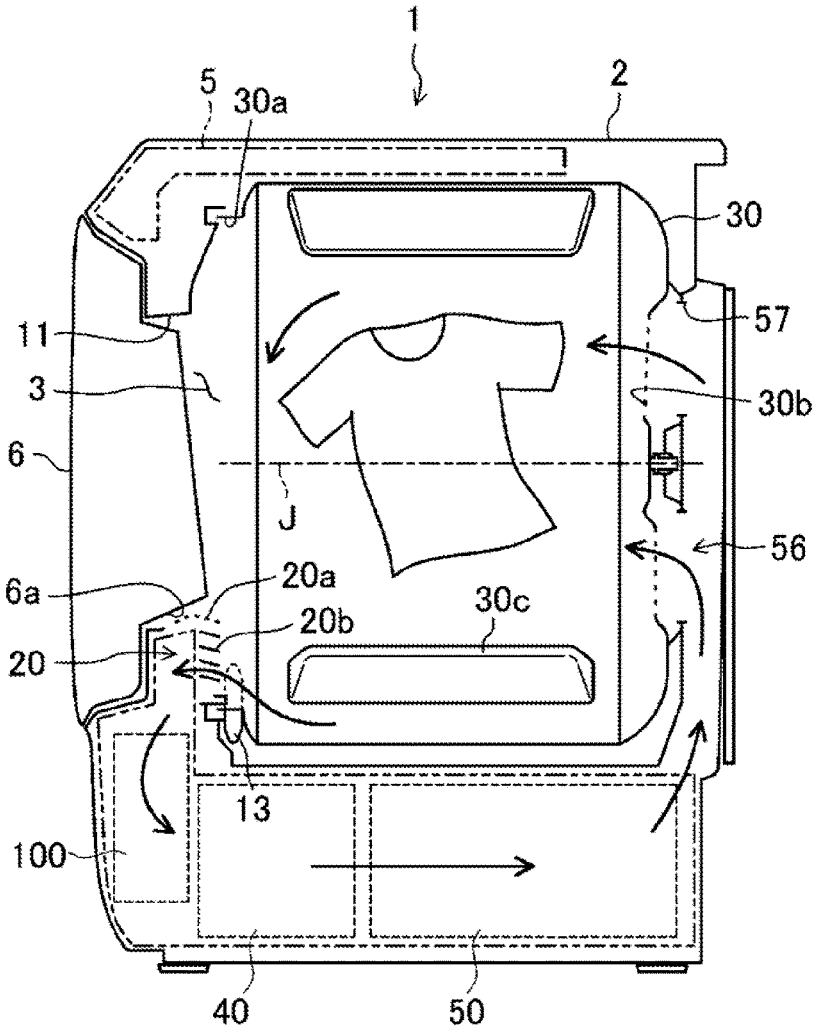
FIG. 2 is a schematic cross-sectional view illustrating an internal structure of the clothes dryer according to one embodiment of the present disclosure.

As illustrated in FIGS. 1 and 2, a clothes dryer 1 according to an embodiment of the present disclosure includes a case 2 having an approximately rectangular parallelepiped shape which is slightly longer vertically, and an entrance 3, through which clothes may be put in or taken out, formed in an upper portion of a front surface of the case 2.

The entrance 3 may have a horseshoe-shaped exterior. Specifically, an upper portion of an edge of the entrance 3 is formed in a semi-circular (a major arc) shape which is larger than a half of a circumference, and a lower portion of the edge of the entrance 3 is formed in a linear (a chord) shape which extends in a transverse direction (i.e., in an approximately horizontal direction).

An operating part 4 such as a touch panel is installed above the entrance 3. An electronic component 5 such as a circuit board is installed at an inside of the case 2 which is located at a rear side of the operating part 4. A door 6 is attached to the front surface of the case 2 via a hinge 6*b*, and the entrance 3 is opened and closed by the door 6.

A ring-shaped concave portion 2*a* which has been recessed to form a ring shaped cavity, an outer flange portion 2*b* which protrudes from an inner edge of the concave portion 2*a* so as to define the entrance 3, and an cylindrical inner flange portion 11 which protrudes from an inner edge of the outer flange portion 2*b* toward an inside of the case 2 are formed in a front portion of the case 2.

A convex portion 6*a* which is inserted into the ring-shaped concave portion 2*a*, the outer flange portion 2*b* and the inner flange portion 11 is formed at an entrance 3 side of the door 6. An air exhaust vent 20 is formed at a lower end of the inner flange portion 11.

(Drum)

A drum 30 which accommodates the clothes is installed inside of the case 2. The drum 30 is a cylindrical member having a bottom and an opening 30*a* which is formed at a front end thereof and through which the clothes may be put in or taken out. The drum 30 is supported by the case 2 so as to adapt a state in which the opening 30*a* faces the entrance 3, and also to be freely rotated about a transverse axis J extending in the longitudinal direction.

Specifically, a center portion of a rear end of the drum 30 is axially supported by a rear portion of the case 2, and a circumferential edge of a front end of the drum 30 is supported by a plurality of guide rollers 13 installed at the front portion of the case 2.

A circular air vent hole 30*b* covered by a mesh filter may be formed at the rear end of the drum 30. A stirring plate 30*c* is attached on an inner surface of the drum 30. During a spin-dry process, the drum 30 is rotated by a driving motor which is not shown.

(Constituent Devices)

Figure 3:
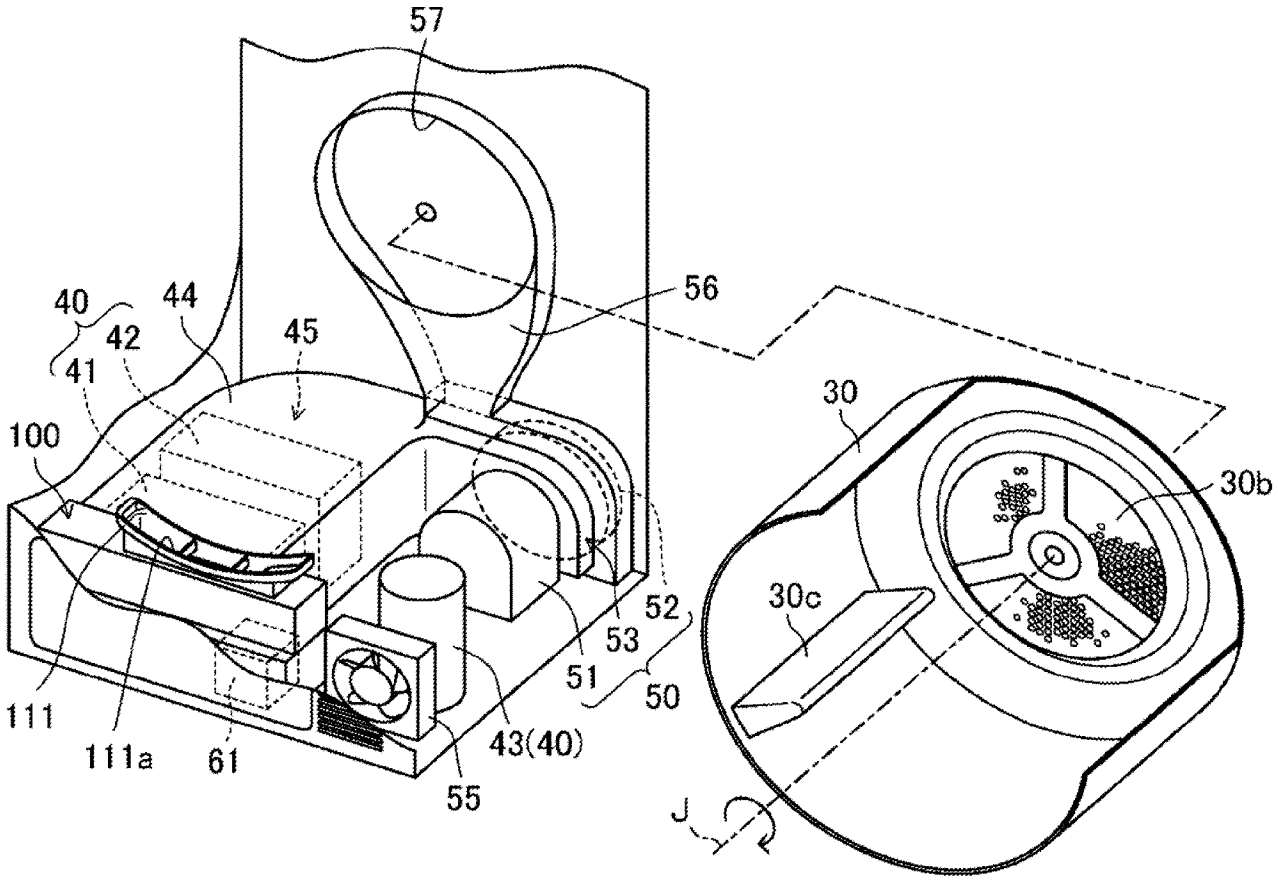
FIG. 3 is a schematic perspective view illustrating main elements of the clothes dryer according to one embodiment of the present disclosure.

As illustrated in FIG. 3, main devices of the clothes dryer 1, such as an air conditioning device 40, an air blowing device 50 and a lint removing device 100, are arranged aggregately at a lower portion of the clothes dryer 1.

Since these devices are arranged at the lower portion of the clothes dryer 1, it is possible to ensure a sufficient installation space and also to select and utilize large and strong devices. Thus, since a center of gravity is lower, the clothes dryer 1 may be stably installed. Also, since a vibration source which generates vibration during the spin-dry process is located at the lower side of the drum 30, the vibration may be suppressed.

(Air Conditioning Device)

The air conditioning device 40 includes an evaporator 41, a condenser 42, a compressor 43 and the like. A duct cover 44 is installed at the lower portion of the drum 30. The duct cover 44 is attached to a bottom surface of the case 2, and an air exhaust duct 45 configured to extend in a front and rear direction and having a large width is provided.

Both the evaporator 41 and the condenser 42 may have rectangular parallelepiped exteriors having large widths, and are accommodated in the duct cover 44, while in a state of being frontward and rearward, respectively. Therefore, the air exhausted from the air exhaust vent 20 during the spin-dry process is blown in at a front side of the evaporator 41, cooled and dehumidified in the evaporator 41, reheated in the condenser 42, and then transferred to the air exhaust duct 45 in a dried state.

The compressor 43 may be disposed at a left side of the duct cover 44. Also, a valve, a pipe or the like is installed at the air conditioning device 40, but is not illustrated in the drawings.

(Air Blowing Device)

The air blowing device 50 includes a fan motor 51, an air blower fan 52, a fan cover 53 and the like, and may be disposed at a rear side of the compressor 43, which is located at a rear portion of the clothes dryer 1. An external air intake fan 55 which blows external air into the inside of the case 2 may be disposed at a front side of the compressor 43.

The air blower fan 52 is, for example, a centrifugal fan, and is covered by the fan cover 53. An inlet port and an outlet port are provided in the fan cover 53, and the inlet port is connected with a rear end (a downstream side) of the air exhaust duct 45.

An air supply duct 56 may be installed along an inner surface of a rear wall of the case 2. The outlet port of the fan cover 53 is connected with one end of the air supply duct 56. A circular air supply hole 57 is formed at the other end of the air supply duct 56. The air supply hole 57 is in contact with the air vent hole 30*b* of the drum 30, and thus the air supply duct 56 communicates with a rear portion of the drum 30 through the air supply hole 57 and the air vent hole 30*b*.

The air blower fan 52 is rotated during the spin-dry process by the fan motor 51, and an air flow from the air exhaust vent 20 toward the air supply hole 57 occurs. Therefore, air circulation via the drum 30 is generated (referring to an arrow in FIG. 2). Due to cooperation between the air blower fan 52 and the air conditioning device 40, humid air flows out from the drum 30 through the opening 30*a* and the air exhaust vent 20, and dried air through the air supply hole 57 and the air vent hole 30*b* is introduced into the drum 30.

Figure 9:
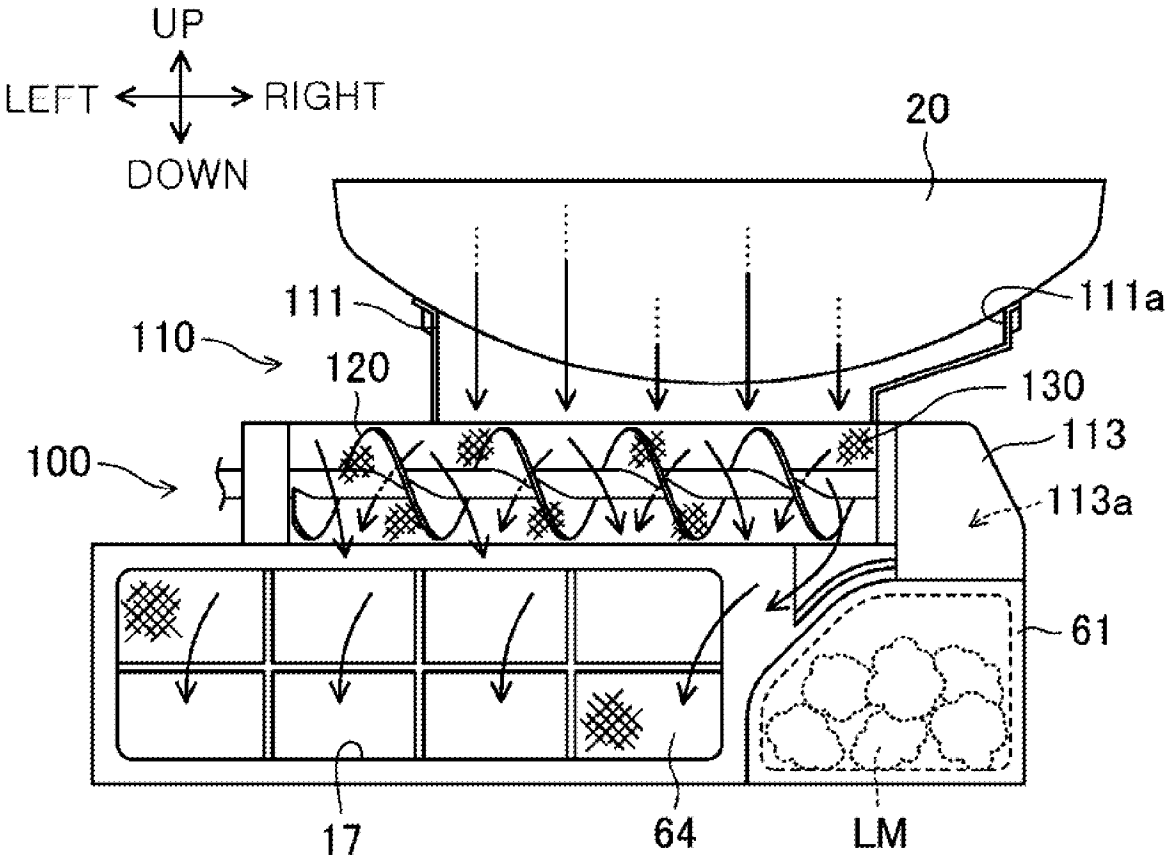
FIG. 9 is a schematic view illustrating a flow of air discharged from a drum according to one embodiment of the present disclosure.

An air introduction hole 111*a* (referring to FIG. 3) formed lengthwise in the transverse direction in the lower surface of the inner flange portion 11 to receive the air is formed to be open upwardly. The air introduction hole 111*a* communicates with the air exhaust duct 45 through an air intake 17 (FIG. 9).

(Air Exhaust Hole)

As illustrated in FIG. 2, the air exhaust vent 20 is configured with a plurality of blades or the like, and installed at a lower end of the inner flange portion 11. An upper portion 20*a* of the air exhaust vent 20 is formed in a rectangular shape which is formed lengthwise in the transverse direction. An inner side 20*b* of the air exhaust vent 20 is formed in a bow shape, and disposed to face backward and forward of a lower end of the opening 30*a* of the drum 30.

When the door 6 is closed, the upper portion 20*a* of the air exhaust vent 20 faces above and below the convex portion 6*a* of the door 6 with a gap therebetween, and the inner side 20*b* of the air exhaust vent 20 faces an inside of the drum 30. That is, when the door 6 is closed, the air exhaust vent 20 communicates with a front portion of the drum 30. During the spin-dry process, the air in the drum 30 passes the inner side 20*b* of the air exhaust vent 20 and flows downward.

(Lint Removing Device)

The lint removing device 100 is a device which removes the lint in the air flowing out from the air exhaust vent 20.

Figure 4:
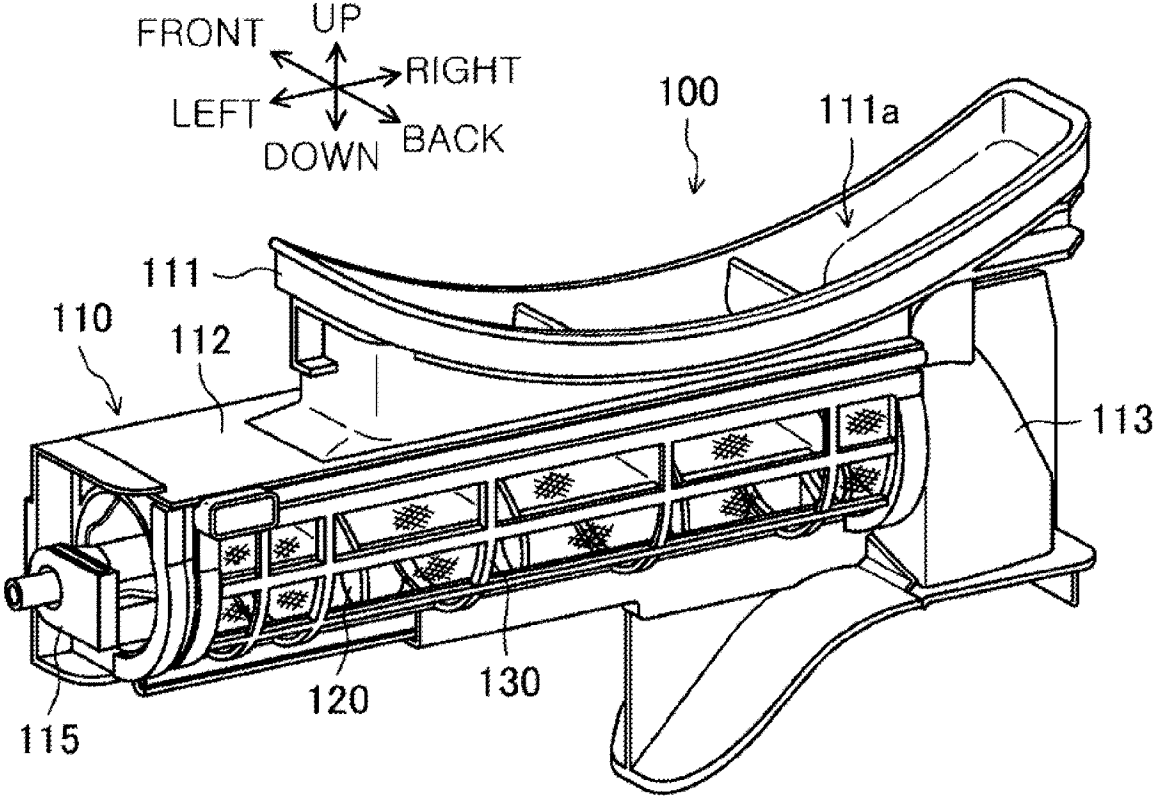
FIG. 4 is a schematic perspective view illustrating a lint removing device according to one embodiment of the present disclosure.
Figure 5:
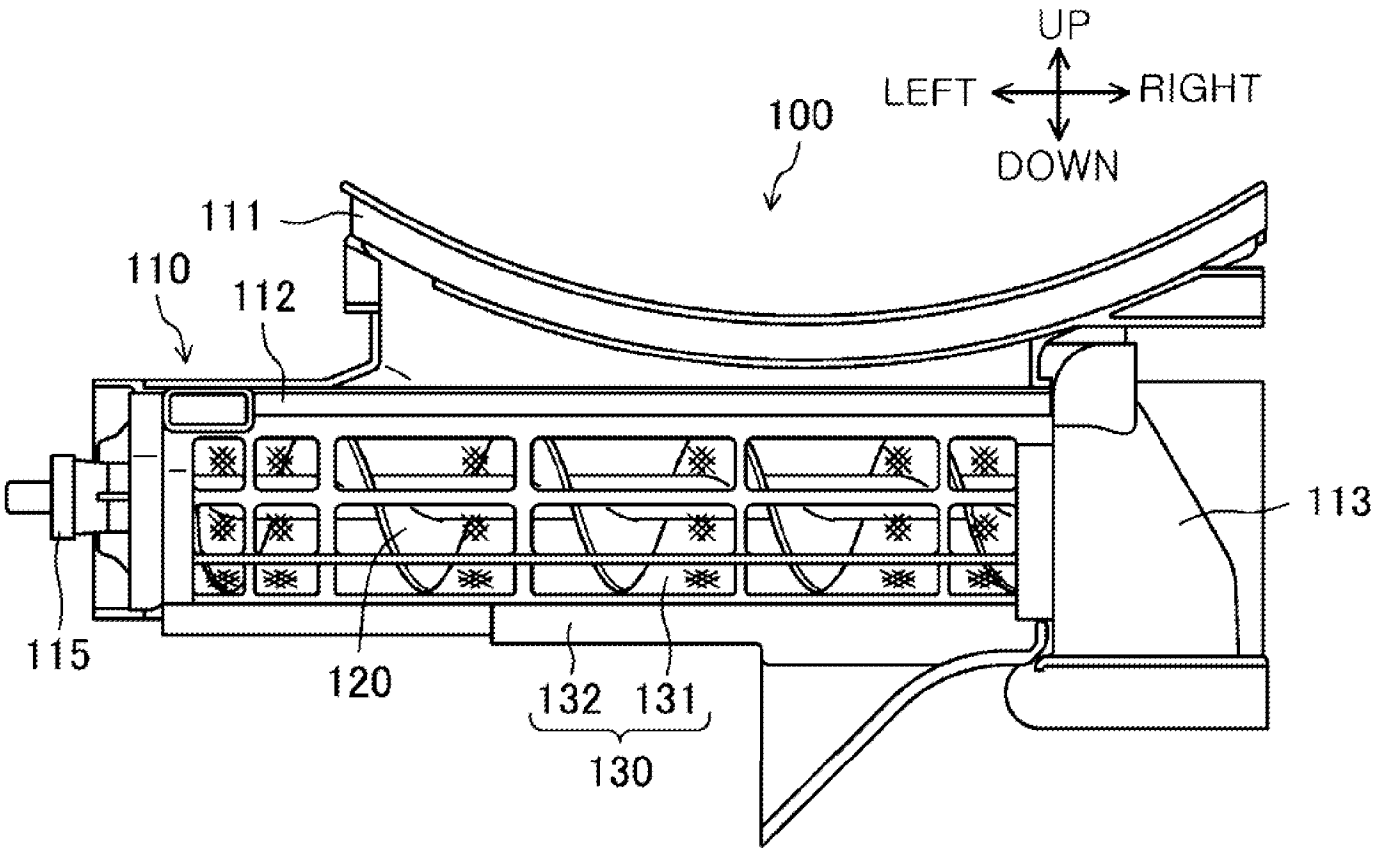
FIG. 5 is a front view illustrating the lint removing device according to one embodiment of the present disclosure.
Figure 6:
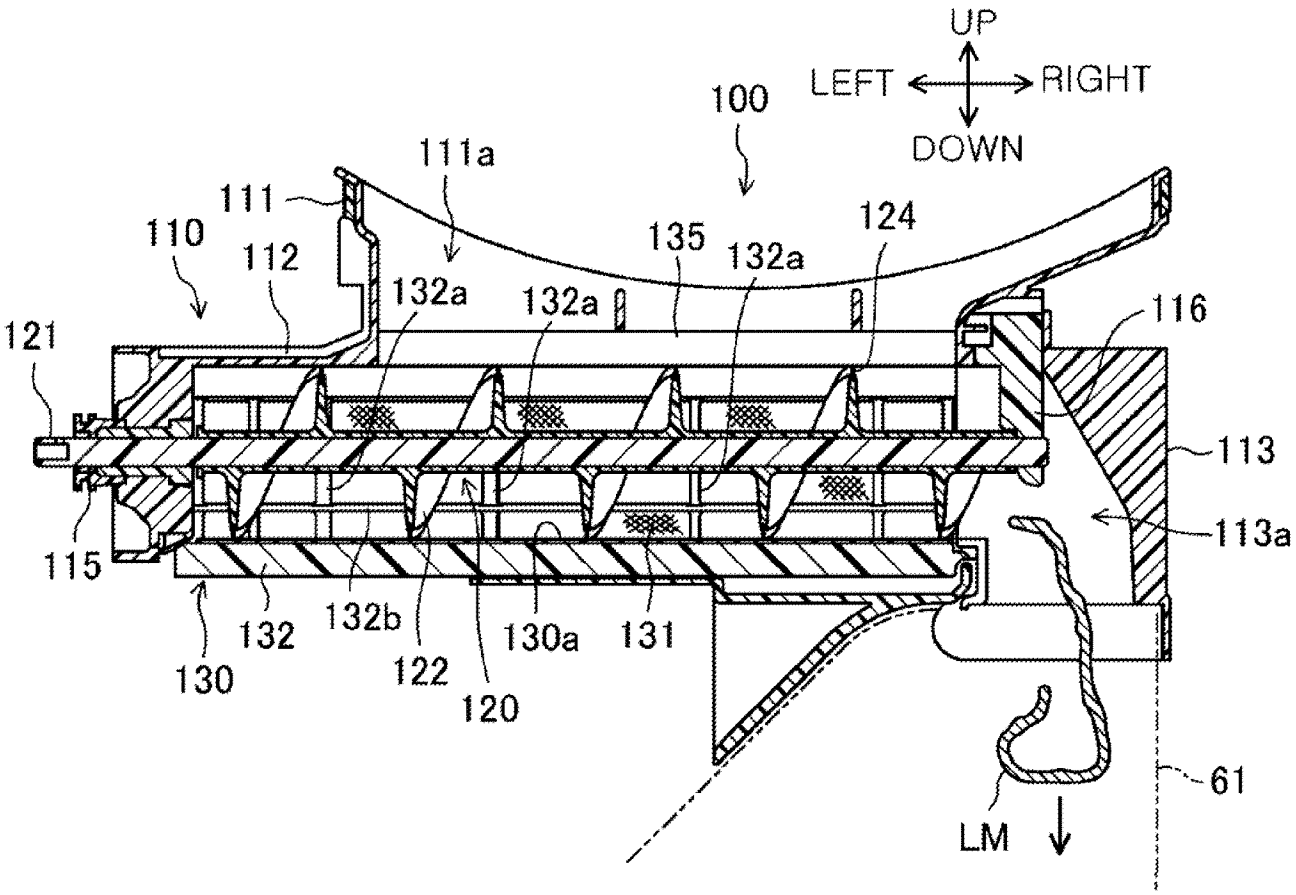
FIG. 6 is a schematic cross-sectional view schematically illustrating the lint removing device according to one embodiment of the present disclosure.

FIGS. 4 to 6 illustrate a structure of the lint removing device 100 in detail. The lint removing device 100 includes a frame member 110, a screw 120, a lint filter 130 and the like.

The screw 120 includes a rotating shaft 121 and a spiral blade 122, and is formed lengthwise in the transverse direction. An elastic member 124 is installed at an outer edge of the blade 122 of the screw 120. Specifically, an installation part 122*a* is installed at an outer edge of the blade 122 over an entire circumference along a spiral shape of the blade 122, and the elastic member 124 is fitted onto the installation part 122*a*, and thus attached to the outer edge of the blade 122 (referring to FIG. 11). An outer diameter of the blade 122 including the elastic member 124 is designed to be the same over an entire area, and an outer edge of the blade 122 is in contact with an inner circumferential surface of the lint filter 130. That is, an outer edge of the blade 122 is configured to maintain contact with the inner circumferential surface of the lint filter 130. Also, for example, the elastic member 124 may include or be comprised of one of a rubber material, a resin material and a brush. The embodiment of the present disclosure illustrates an example in which a groove for installing the elastic member 124 is formed at the installation portion of the blade 122. However, the scope of the present disclosure is not limited thereto. For example, the installation portion may include a protrusion which protrudes outward from the blade.

Also, when the entire circumference of the outer edge of the blade 122 is in contact with the inner circumferential surface of the lint filter 130, the lint filter 130 may become worn. However, the problem may be solved by the embodiment configured as follows.

First, a member that is in contact with the lint filter 130 is the elastic member 124, rather than the entire circumference of the outer edge of the blade 122. Second, the elastic member 124 may definitely scrape off the lint, and also the lint filter 130 is formed of a durable material, e.g., a material that does not wear out quickly. Third, the elastic member 124 may definitely scrape off the lint, and also a height of the elastic member 124 is controlled so that the lint filter 130 is difficult to become worn. That is, a height of the elastic member is controlled to minimize wear of the lint filter.

Fourth, a roughness of a mesh of the lint filter 130 is selected so that collectability of the lint is combined with wear resistance.

Figure 7:
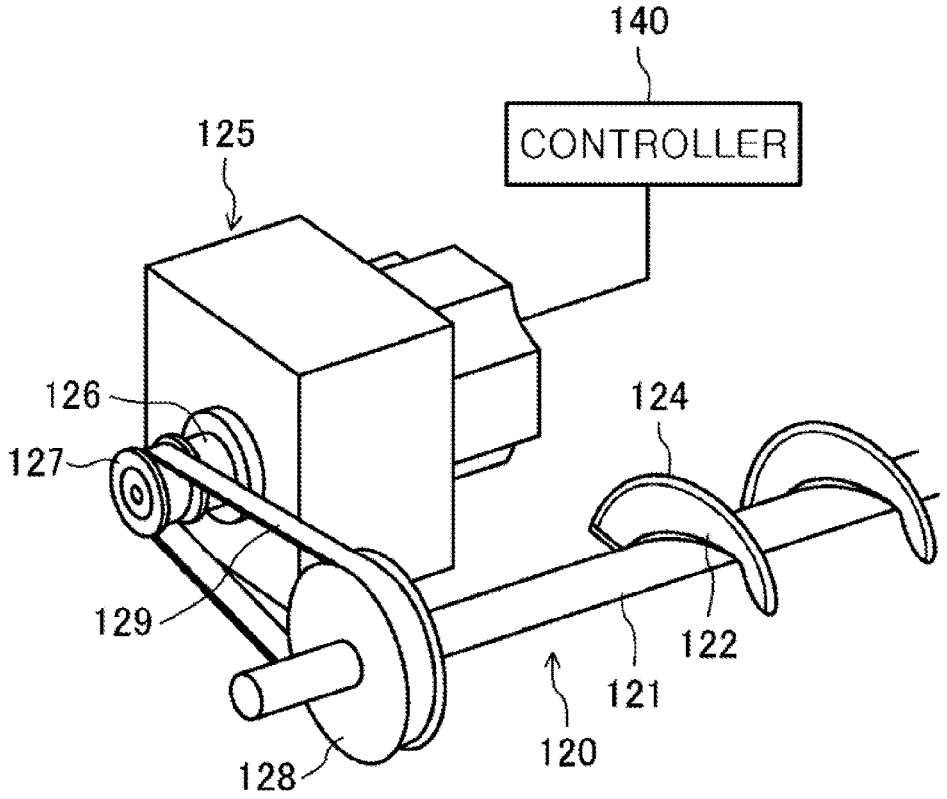
FIG. 7 is a perspective view illustrating an arrangement of a screw motor according to one embodiment of the present disclosure.

As illustrated in FIG. 7, the screw 120 is rotated by a screw motor 125. The screw motor 125 is disposed adjacent to the screw 120 so that a motor shaft 126 is in parallel with the rotating shaft 121.

A motor side pulley 127 is installed on the motor shaft 126 of the screw motor 125. A screw side pulley 128 having a greater outer diameter than the motor side pulley 127 is installed on the rotating shaft 121 of the screw 120. A pulley belt 129 is wound on the motor side pulley 127 and the screw side pulley 128, and a rotating force of the screw motor 125 is transferred to the screw 120 through the pulley belt 129. Also, the screw motor 125 may be directly connected with the rotating shaft 121 of the screw 120.

A rotating direction of the screw motor 125 is changed by a controller 140. For example, the controller 140 is the electronic component 5 which is assembled on a circuit board, as illustrated in FIG. 2.

The controller 140 changes a rotation motion of the screw motor 125 so that a reverse rotation motion in which the lint scraped off by the screw 120 is conveyed from a downstream side of an axial direction of the lint filter 130 toward an upstream side thereof is performed for a predetermined period of time, and then a forward rotation motion in which the lint is conveyed from the upstream side toward the downstream side is performed.

Therefore, for example, when the lint remains at an upstream end of the axial direction of the lint filter 130, the reverse rotation motion is performed, and thus the lint may be attached to and definitely collected by the screw 120.

As illustrated in FIGS. 4 to 6, the frame member 110 includes an air introduction part 111, a lint processing part 112, a lint drawing part 113 and the like. The air introduction part 111 is a cylindrical portion which is formed lengthwise in the transverse direction so that the air passing through the air exhaust vent 20 and flowing downward is introduced into the lint processing part 112. The air introduction hole 111*a* formed lengthwise in the transverse direction so as to receive the air is formed at an upper portion of the air introduction part 111 to be open upwardly.

The lint processing part 112 is continuously installed at a lower side of the air introduction part 111, and the screw 120 is shifted to be offset toward a right side with respect to the air introduction part 111.

An upstream side supporting part 115 and a downstream side supporting part 116 are disposed at upstream and downstream sides of the lint processing part 112, respectively. Upstream and downstream ends of the rotating shaft 121 of the screw 120 are rotatably supported by the upstream side supporting part 115 and the downstream side supporting part 116, respectively. The downstream side supporting part 116 extends downward from a ceiling portion of the lint drawing part 113, and is disposed in a discharging space 113*a* of the lint drawing part 113.

The lint filter 130, which is formed lengthwise in the transverse direction and has a "U"-shaped cross section, is removably installed at the lint processing part 112 to cross an air passage. The lint filter 130 is integrally configured with a sheet-shaped mesh filter 131 having a hole diameter through which the lint does not pass, and a filter frame 132 formed lengthwise in the transverse direction to support the mesh filter 131 and to have a "U"-shaped cross section.

A frame part 132*a* which extends in a circumferential direction of the mesh filter 131, and a frame beam part 132*b* which extends in an axial direction of the mesh filter 131 are installed at the filter frame 132. The frame part 132*a* is extended perpendicular to the axial direction of the mesh filter 131.

The lint filter 130 is installed at the lint processing part 112 so that an inner surface (collecting surface 130*a*) having a circular arc-shaped cross section is directed to an upstream side of the air passage, and so that the collecting surface 130*a* corresponds to the screw 120.

An inner diameter of the collecting surface 130*a* is set to be approximately the same as an outer diameter of the blade 122 including the elastic member 124, and thus the elastic member 124 installed at the outer edge of the blade 122 comes in contact with the inner circumferential surface of the lint filter 130 and the lint collected on the collecting surface 130*a* is scraped off.

Figure 8:
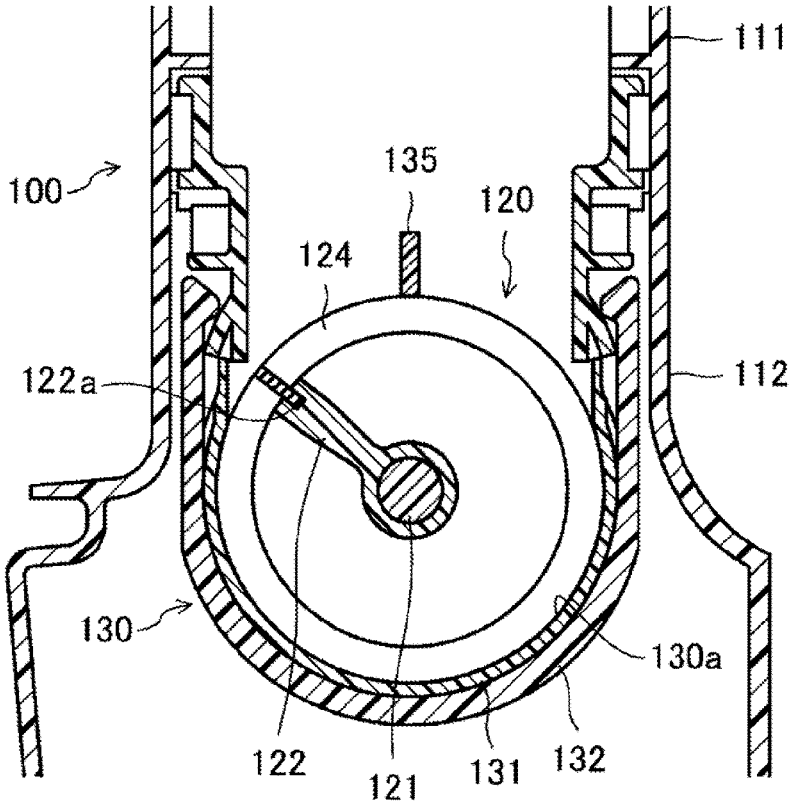
FIG. 8 is a side cross-sectional view illustrating a structure of a contact rib according to one embodiment of the present disclosure.

As illustrated in FIG. 8, a plate-shaped contact rib 135 which extends in the axial direction of the lint filter 130 and having a main surface vertical e.g., perpendicular with respect to the axial direction of the lint filter is formed at an opening side of the lint filter 130. The contact rib 135 is disposed at a position that is in contact with the elastic member 124 installed at the blade 122 of the screw 120. Therefore, even when the lint is caught on the outer edge of the screw 120, the lint may come into contact with the contact rib 135, may be scraped off, and thus may be prevented from remaining between the lint filter 130 and the screw 120.

The lint removing device 100 is set to not be operated during the spin-dry process of the clothes, but to be operated for a predetermined period of time during the spin-dry process (e.g., after an operation of the clothes dryer 1 is finished, before the operation of the clothes dryer 1 has started, or when the air blowing device or the air conditioning device is not being operated).

That is, during the spin-dry process, the lint in the air is collected by the lint filter 130 and accumulated on the collecting surface 130*a*. The lint filter 130 is designed to have a size and a shape that are not clogged by an amount of the lint collected in one spin-dry process.

As a result, a layer-shaped batch of lint (a lint layer LM) is formed by the lint remaining on the collecting surface 130*a*, after the spin-dry process is finished. The lint layer LM is scraped off from the lint filter 130 by rotation of the screw 120, and then pushed out to a left side of the lint filter 130.

Since the lint removing device 100 is not operated during the spin-dry process, and the lint may be removed in one batch, the lint may be removed in as short a time as possible. As a result thereof, a complicated control or a sophisticated device is not needed, and a material cost and an operating cost may be reduced.

The lint drawing part 113 is a cylindrical portion that is adjacent to a left side of the lint processing part 112 and located at a lower side of a left end of the air introduction part 111, and has the discharging space 113*a* formed therein. The lint drawing part 113 serves to receive the lint layer LM pushed out from the lint filter 130 and to induce the lint layer LM into a lint box 61.

(Lint Box)

As illustrated in FIG. 9, the lint box 61 may be formed in a box shape of which an upper side is open, and disposed under the lint drawing part 113. The lint layer LM falling from the lint drawing part 113 is accumulated in the lint box 61.

Since the lint box 61 is disposed at a portion adjacent to the left end of the lint filter 130 from which the lint layer LM is pushed out, the lint layer LM which is difficult to be conveyed may be easily conveyed to the lint box 61 without using a complicated conveying device.

Since the lint box 61 is disposed under the lint drawing part 113 adjacent to the left side of the lint filter 130, the lint layer LM pushed out from the lint filter 130 may fall into the lint box 61.

A secondary filter 64 has a sheet-shaped screen filter formed lengthwise in the transverse direction to cover the air intake 17, which is open at a front side of the air exhaust duct 45. The screen filter of the secondary filter 64 is formed using the mesh filter, which has a smaller hole diameter than that of the lint filter 130.

<Angle of Screw Pin>

Figure 10:
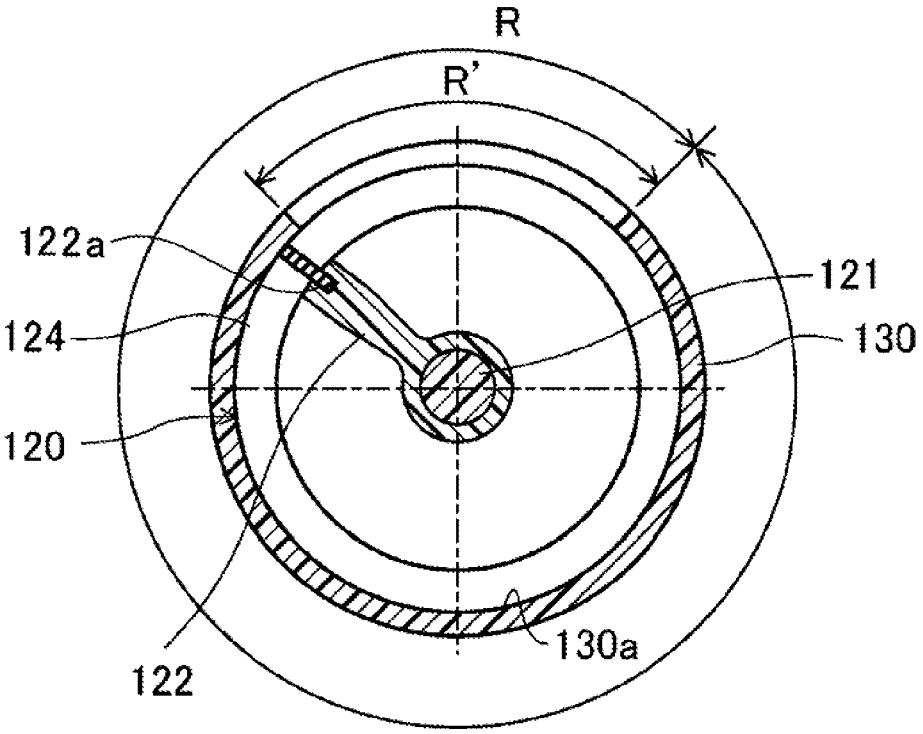
FIG. 10 is a side cross-sectional view illustrating a length of an opening of a lint filter according to one embodiment of the present disclosure.

As illustrated in FIG. 10, a part of a circumference of an upper side of the lint filter 130 is open so that air may be blown into an inside of the lint filter 130. Here, when an angle of the blade 122 of the screw 120 for conveying the lint is too small, the lint which is being conveyed from the opening of the lint filter 130 may overflow from the opening of the lint filter 130. Also, when the angle of the blade 122 is too large, a downstream side of the blade 122 may be easily clogged with lint.

Therefore, in the embodiment, the angle of the blade 122 of the screw 120 is set appropriately, and thus lint which is being conveyed by the screw 120 may be prevented from overflowing from the opening of the lint filter 130 and clogging the downstream side of the blade 122.

Specifically, as illustrated in FIG. 10, assuming that an entire circumferential length of the cylindrical portion in the lint filter 130 formed to have the same curvature radius as the surface having the circular arc-shaped cross section is R mm, and a circumferential length of the opening of the lint filter 130 is R' mm, a size of the opening of the lint filter 130 is set to satisfy the following Equation 1.

$$R'/R=1/4 \quad (1)$$

Figure 11:
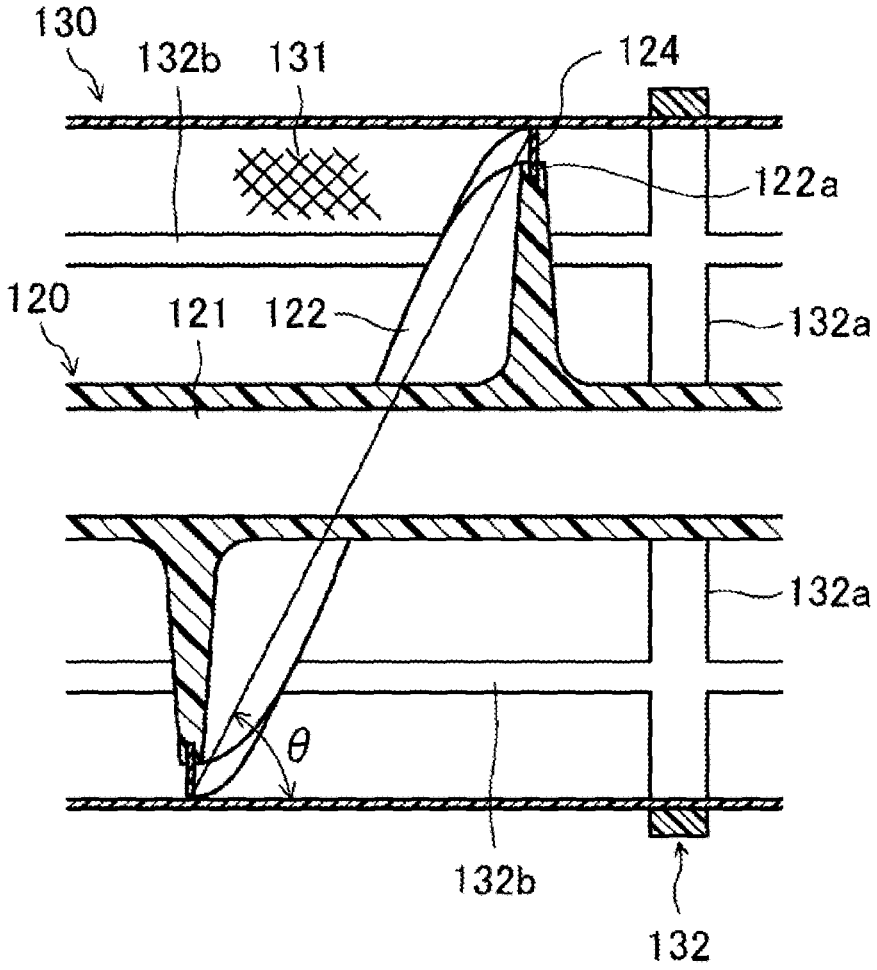
FIG. 11 is a cross-sectional view illustrating an angle of a screw blade according to one embodiment of the present disclosure.

As illustrated in FIG. 11, in the case in which the opening of the lint filter 130 has the size which satisfies Equation 1, assuming that the angle of the blade 122 of the screw 120 is θ°, the angle is set to satisfy the following Equation 2.

$$45°<\theta<70° \quad (2)$$

By using the screw 120 which is formed to satisfy Equation 2, the lint which is being conveyed by the screw 120 may be prevented from overflowing from the opening of the lint filter 130 and also the lint may be definitely conveyed.

Meanwhile, the angle θ of the blade 122 may be set to 60°. However, this is just an example, and a value of the angle may be not limited, as long as it satisfies Equation 2.

<Rotational Speed of the Screw>

In the embodiment, a rotational speed of the screw 120 is set appropriately, and thus the lint may be definitely collected. Specifically, assuming that the rotational speed of the screw 120 is Rs rpm, the rotational speed is set to satisfy the following Equation 3.

$$20 \text{ rpm}<Rs<25 \text{ rpm} \quad (3)$$

By rotating the screw 120 at Rs rpm, a driving force of the screw 120 may be sufficiently ensured, the lint may be definitely conveyed, and also a collected amount of the lint may be increased.

Figure 12:
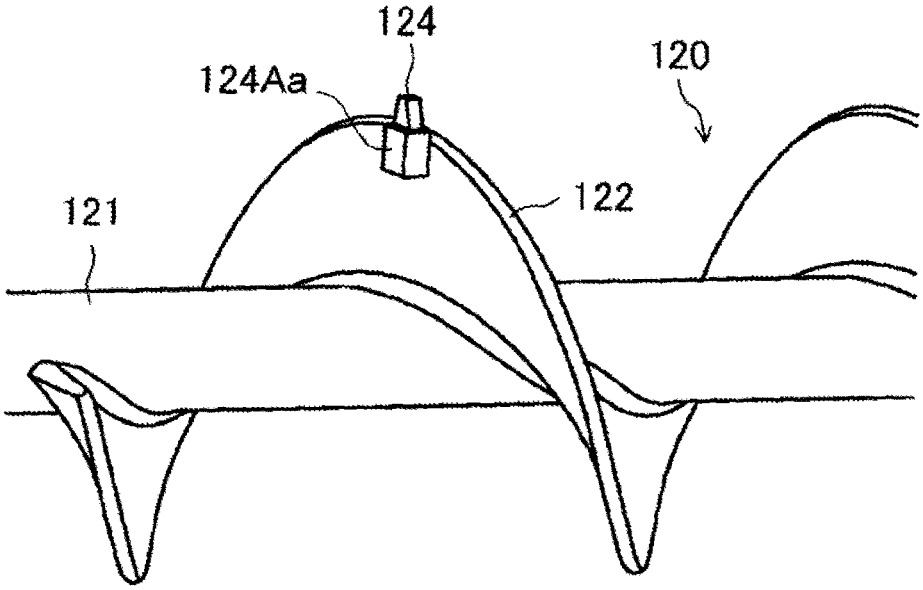
FIG. 12 is a perspective view illustrating a structure of a screw according to another embodiment of the present disclosure.

FIG. 12 is a perspective view illustrating a structure of a screw according to another embodiment of the present disclosure. The same reference numerals refer to the same elements as those of the first embodiment, and only differences between the embodiments will be described.

As illustrated in FIG. 12, the elastic member 124 is installed on the blade 122 of the screw 120 to protrude radially.

For example, the elastic member 124 may be formed of the rubber material, a resin material, the brush or the like, and a front end thereof is in contact with the inner circumferential surface of the lint filter 130.

At this time, the blade 122 may further include an elastic member installing part 124Aa for installing the elastic member 124. The elastic member installing part 124Aa may be formed at one of an end and both side surfaces of the blade 122.

Also, the elastic member 124 may be installed to protrude toward an outside of the elastic member installing part 124Aa.

Figure 13:
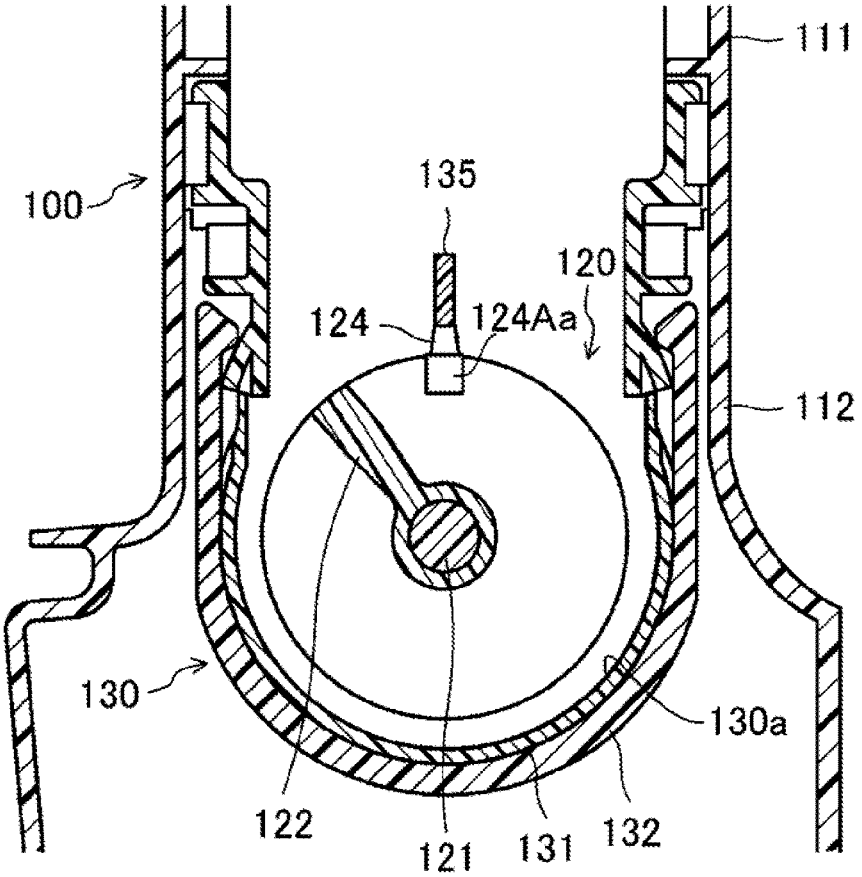
FIG. 13 is a side cross-sectional view illustrating a structure of a contact rib according to another embodiment of the present disclosure.

As illustrated in FIG. 13, an inner diameter of the collecting surface 130*a* is set larger than an outer diameter of the blade 122, and a predetermined gap is formed between the blade 122 and the collecting surface 130*a* along the entire axial direction.

Here, lint may be formed by entangled fibers, and thus has a feature in which it is difficult to be separated. Therefore, when the thin layer-shaped lint collected on the inner circumferential surface of the lint filter 130 is partially scraped off by the elastic member 124 installed on the screw 120, and then pushed by the blade 122, the portion scraped off by the elastic member 124 becomes rolled up, and the thin layer-shaped lint is thereby twisted, and thus the entire lint may be conveyed.

As described above, when the gap is formed between the lint filter 130 and the screw 120 so that the lint is difficult to be narrow, the lint may be scraped off by the elastic member 124 installed at the screw 120 using the feature of the lint.

Also, a structure is described in which one elastic member 124 is installed, but embodiments are not limited thereto. For example, the elastic member 124 may be installed at every pitch of the blade 122 spaced in the axial direction. Also, a plurality of elastic members 124 may be disposed at intervals in a circumferential direction of the screw 120. Further, in the case in which the plurality of elastic members 124 are installed, each elastic member 124 may be set to have a different height, and thus to form a step difference. Furthermore, the elastic member 124 may be removably installed at the blade 122 of the screw using a fitting method, a press fitting method or a screw method, and thus may be easily replaced with new one.

Figure 14:
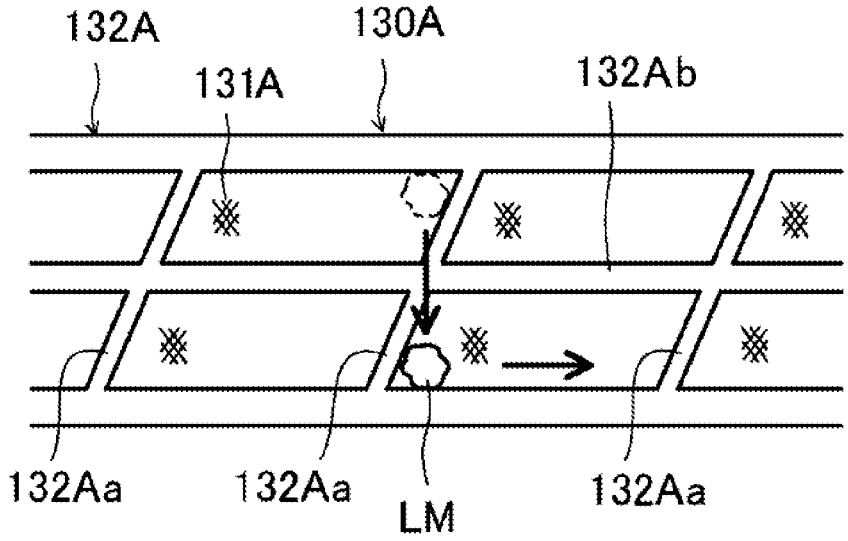
FIG. 14 is a schematic front view illustrating a structure of a lint filter according to another embodiment of the present disclosure.

FIG. 14 is a schematic front view illustrating a structure of a lint filter according to another embodiment of the present disclosure. As illustrated in FIG. 14, the lint filter 130A is integrally configured with a sheet-shaped mesh filter 131A having a hole diameter through which the lint does not pass, and a filter frame 132A formed lengthwise in the transverse direction to support the mesh filter 131A and to have a "U"-shaped cross section.

A frame part 132Aa which extends in a circumferential direction of the mesh filter 131A, and a frame beam part 132Ab which extends in an axial direction of the mesh filter 131A are installed at the filter frame 132A.

The frame part 132Aa is formed to be inclined with respect to the axial direction of the mesh filter 131A. Specifically, the frame part 132Aa is formed to be inclined, such that an upper end of the frame part 132Aa is located at a more downstream location in a lint conveying direction than a lower end thereof.

As described above, since the frame part 132Aa is formed to be inclined in the axial direction of the lint filter 130A, the lint layer LM scraped off by the contact rib 135A (not shown) and falling may be easily collected. That is, in an upstream section divided by the frame part 132Aa, since the lint layer LM (indicated by an arrow in FIG. 14) scraped off by the contact rib 135A falls, and thus is moved into a downstream section, it is easy to collect the lint layer LM.

Also, when the frame part 132Aa is inclined in an opposite direction to an example illustrated in FIG. 14, i.e., even when the frame part 132Aa is inclined so that the upper end thereof is located at a more upstream side in the lint conveying direction than a lower end thereof, it is possible to obtain the same effect.

Figure 15:
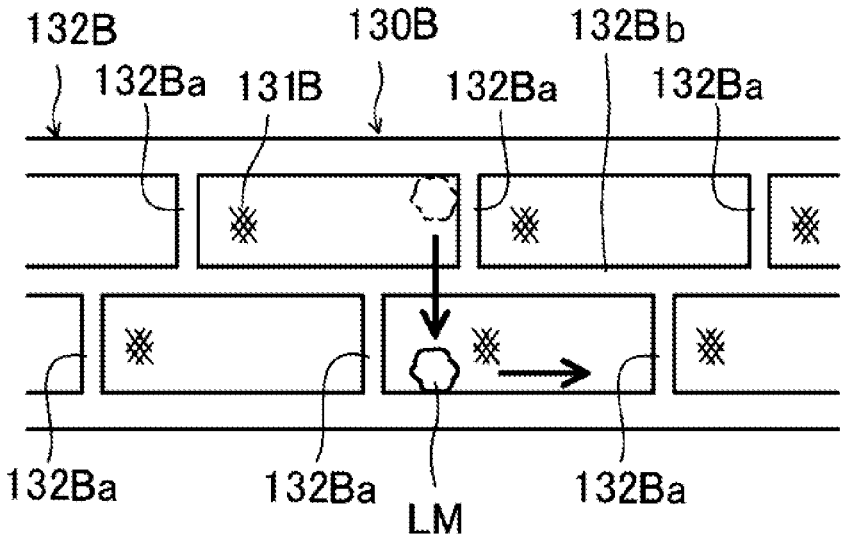
FIG. 15 a schematic front view illustrating a structure of a lint filter according to still another embodiment of the present disclosure.

FIG. 15 a schematic front view illustrating a structure of a lint filter according to still another embodiment of the present disclosure. As illustrated in FIG. 15, the lint filter 130B is integrally configured with a sheet-shaped mesh filter 131B having a hole diameter through which the lint does not pass, and a filter frame 132B formed lengthwise in the transverse direction to support the mesh filter 131B and to have a "U"-shaped cross section.

One pair of upper and lower frame parts 132Ba and 132Ba which extend in a circumferential direction of the mesh filter 131B, and a frame beam part 132Bb which extends in an axial direction of the mesh filter 131B are installed at the filter frame 132B.

Here, the pair of upper and lower frame parts 132Ba and 132Ba each extend along a circumference of the lint filter 130B in opposite directions to each other, and are disposed at positions shifted with respect to each other in the axial direction of the lint filter 130B.

As described above, since the pair of upper and lower frame parts 132Ba and 132Ba are disposed at the positions shifted with respect to each other in the axial direction of the lint filter 130B, in an upstream section divided by the frame part 132Ba, the lint layer LM scraped off by the contact rib 135 falls, and thus is moved into a downstream section, it is easy to collect the lint layer LM.

Any of the above-described embodiment may also be configured as follows.

The above-described embodiments refer to an air circulation type clothes dryer 1 in which air is circulated and supplied into the drum 30, but it may also be a gas exhaust type clothes dryer 1A.

Figure 16:
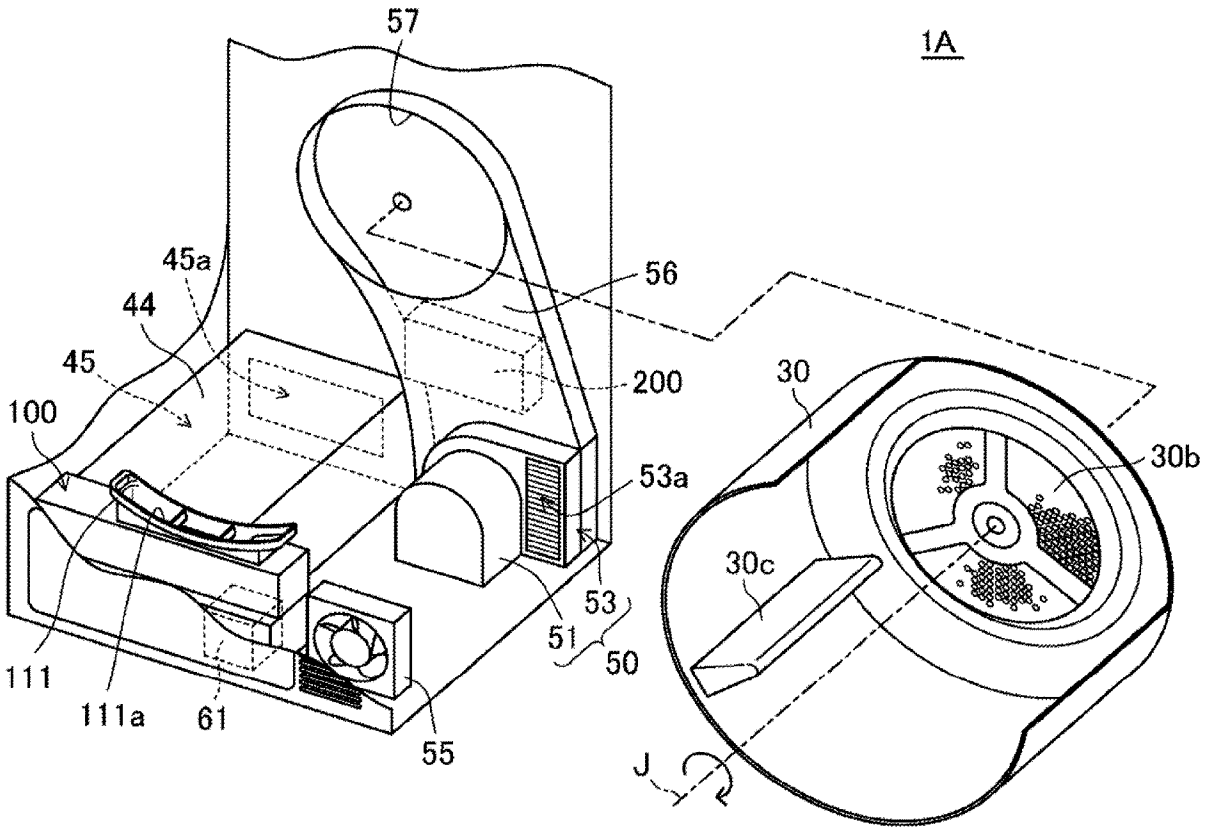
FIG. 16 is schematic perspective view illustrating another shape of the clothes dryer.

FIG. 16 illustrates an example of gas exhaust type clothes dryer 1A. The air conditioning device 40 is not installed inside of the air exhaust duct 45, and a discharge port 45*a* which communicates with an outside of the case 2 is formed at a downstream side of the air exhaust duct 45. An inlet port 53*a* is formed at a side surface of the fan cover 53, and the air blowing device 50 introduces external air therein through the inlet port 54*a*.

The air supply duct 56 is formed separately from the air exhaust duct 45. A heating device 200 such as a heater is installed inside of the air supply duct 56, and the air introduced from the inlet port 53*a* is heated by the heating device 200, and then introduced into the drum 30 through the air supply hole 57.

The air introduced into the air exhaust duct 45 is discharged directly to an outside of the clothes dryer 1 through the discharge port 45*a*.

The lint removing device 100 according to embodiments may alternatively be applied to an air cleaner of a vehicle engine.

Figure 17:
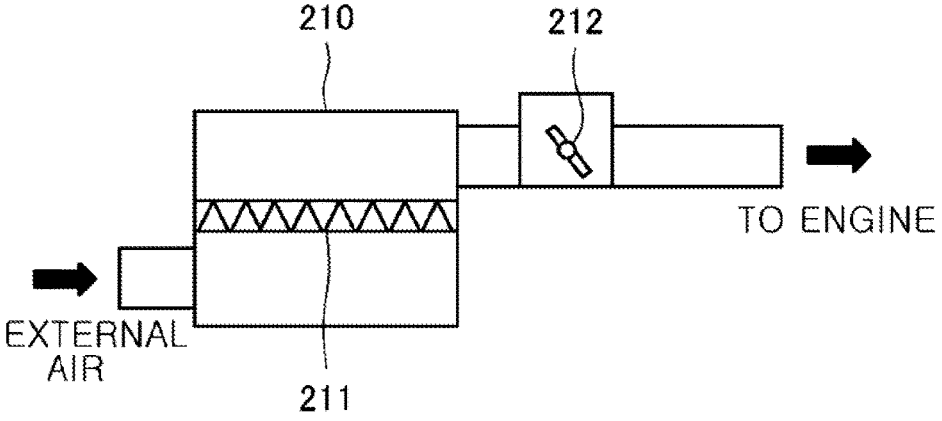
FIG. 17 is a schematic diagram illustrating a first application example of the present disclosure in another product.

FIG. 17 is a schematic diagram of an application example of the present disclosure in another product. As illustrated in FIG. 17, fine substances contained in external air, such as waste and dust, are removed by a filter element 211 in an air cleaner 210, and an air volume is controlled by an air intake valve 212, and then the air is supplied to an engine which is not shown.

The filter element 211 is formed by stacking filter papers in the form of a bellows, and serves to collect the fine substances such as the waste and the dust contained in the air.

When the filter element 211 is continuously used in a dirty state, performance of the engine may be degraded, or fuel efficiency may be degraded. Therefore, the filter element 211 should be cleaned or replaced periodically. However, since the filter element 211 is installed in a case of the air cleaner 210, most users do not clean the filter element 211 every time after driving a vehicle, but instead a cleaning or replacing operation is periodically performed by a maintenance technician.

Therefore, when the filter element 211 is substituted with the lint removing device 100 according to the embodiment, the cleaning or replacing operation is not needed, and an optimal engine output may be always maintained, and also the fuel efficiency may be prevented from becoming degraded.

The lint removing device 100 according to the embodiment may be applied to a first filter of an air cleaner.

Figure 18:
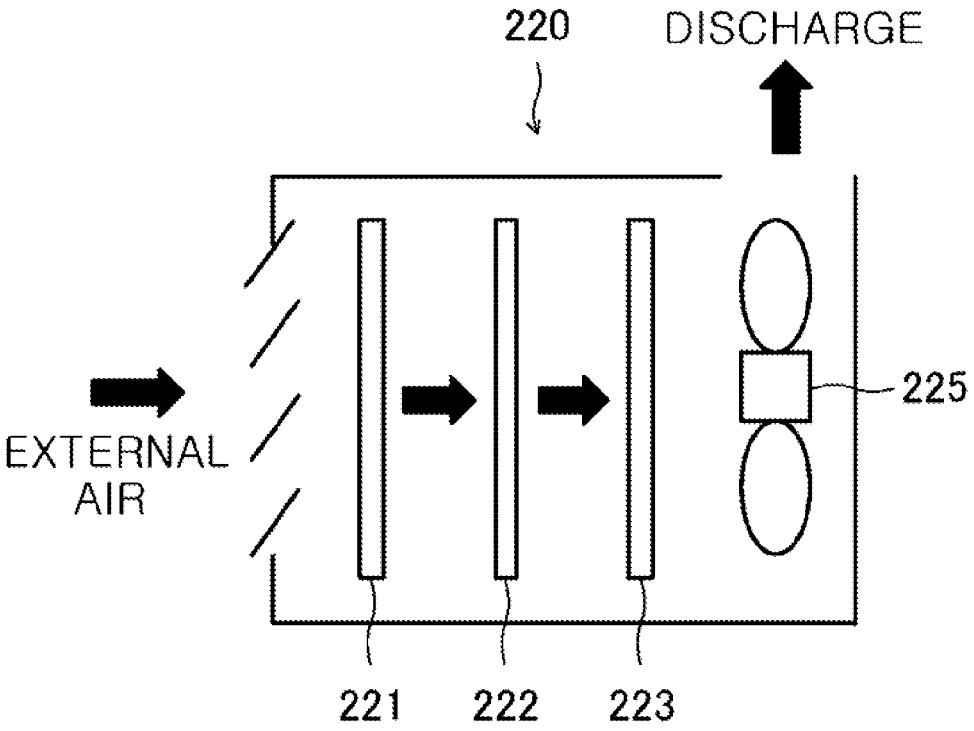
FIG. 18 is a schematic diagram illustrating a second application example of the present disclosure in still another product.

FIG. 18 is a schematic diagram of another application of the present disclosure in still another product.

In an air cleaner 220, as illustrated in FIG. 18, large-sized visible waste, such as hair and thread, contained in external air suctioned by a fan 225 are collected by a first filter 221. Then, fine dust passing through the first filter 221 is filtered by a second filter 222. Finally, an odor causing material passing through the second filter 222 is absorbed and removed by a third filter 223. Then, cleaned air is discharged.

The first filter 221 is mainly formed of a plastic material which may be repeatedly washed and reused, and thus the user should periodically clean the first filter 221.

Therefore, when the first filter 221 is substituted with the lint removing device 100 according to the embodiment, the labor to clean the first filter 221 may be considerably reduced.

According to the present disclosure, the lint collected on the inner circumferential surface of the lint filter can be thoroughly scraped off by the elastic member. Also, when the lint is caught on the outer edge of the screw blade, the lint is in contact with the contact rib, and is scraped off and falls, and thus the lint can be prevented from being sandwiched and remaining between the lint filter and the screw.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dryer comprising:

a drum;

a duct through which drying air is dischargeable from the drum; and a lint removing device, while disposed in a path of the duct, configured to filter lint, wherein the lint removing device includes:

a lint filter having a cylindrical shape, the lint filter having a part of an outer surface that is open;

a screw including:

a spiral blade rotatably provided in an axial direction of the lint filter; and an elastic member protruding from an outer edge of the spiral blade of the screw and configured to be contactable with at least a part of an inner surface of the lint filter; and a plate-shaped contact rib extending in the axial direction of the lint filter, the plate-shaped contact rib having a main surface perpendicular to the axial direction of the lint filter and an edge parallel to the axial direction of the lint filter configured to be contactable with at least a portion of the elastic member protruding from the outer edge of the spiral blade of the screw.

2. The dryer according to claim 1, wherein the edge of the elastic member is disposed to be in contact with a circumference of the inner surface of the lint filter.

3. The dryer according to claim 1, wherein the lint removing device includes a frame in which to install the lint filter, and the frame includes an air introduction part, a lint processing part, and a lint drawing part.

4. The dryer according to claim 1, wherein the lint filter includes a mesh filter and a filter frame, the filter frame configured to extend in a circumferential direction of the lint filter to support the mesh filter.

5. The dryer according to claim 4, wherein the filter frame includes a frame beam part configured to extend in the axial direction of the lint filter, and a plurality of frame parts vertically disposed from the frame beam part.

6. The dryer according to claim 1, wherein a frame part is installed to be inclined in the axial direction of the lint filter.

7. The dryer according to claim 1, wherein the elastic member comprises one of a rubber material, a resin material and a brush.

8. The dryer according to claim 1, wherein an installation part for installing the elastic member is formed at an outer edge of the blade.

9. The dryer according to claim 8, wherein the installation part includes a groove or a protrusion.

10. The dryer according to claim 1, wherein the lint filter has a circumferential length R and a length R' of the opening, and the length R' of the opening is $R'/R=1/4$.

11. The dryer according to claim 1, wherein an angle θ[°] of the blade connected outward from a rotating shaft of the screw is $45<\theta<70$.

12. The dryer according to claim 1, wherein the screw is configured to rotate at a rotational speed Rs [rpm] of $20<Rs<25$.

13. The dryer according to claim 1, further comprising a screw motor configured to rotate the screw, and a controller configured to control a rotating motion of the screw motor.

14. The dryer according to claim 13, wherein the controller changes the rotating motion of the screw motor so that a reverse rotation motion in which the lint is conveyed from a downstream side of the axial direction of the lint filter toward an upstream side thereof is performed for a predetermined period of time, and then a forward rotation motion in which the lint is conveyed from the upstream side toward the downstream side is performed.

15. A lint removing device disposed in a path of a duct to filter lint from air exhaustable from a dryer, the lint removing device comprising:

a frame including a lint processing part;

a lint filter disposed at the lint processing part of the frame, the lint filter having a cylindrical shape of which a part of an outer surface is open;

a screw having a spiral blade rotatably provided in the lint filter and an elastic member protruding from an outside of the spiral blade, the elastic member configured to be contactable with at least an inner surface of the lint filter; and a plate-shaped contact rib extending in an axial direction of the lint filter, the plate-shaped contact rib having a main surface perpendicular to the axial direction of the lint filter and an edge parallel to the axial direction of the lint filter configured to be in contact with the elastic member protruding from the outside of the spiral blade.

16. The device according to claim 15, wherein the lint filter includes a mesh filter, and a filter frame configured to extend in a circumferential direction of the lint filter to support the mesh filter.

17. The device according to claim 16, wherein the filter frame includes a frame beam part configured to extend in the axial direction of the lint filter, and a plurality of frame parts vertically disposed from the frame beam part.

18. The device according to claim 15, wherein a frame part is installed to be inclined in the axial direction of the lint filter.

19. The device according to claim 15, wherein the elastic member includes one of a rubber material, a resin material and a brush.

20. The device according to claim 15, wherein an installation part for installing the elastic member is formed at an outer edge of the blade.

21. A lint removing device configured to remove lint from air flowing out from an exhaust vent of a dryer, the lint removing device comprising;

a frame;

a rotatable screw formed lengthwise in the frame, the rotatable screw including a shaft, blade attached to the shaft, and an elastic member installed at an outer edge of the blade;

a lint filter that is cylindrically shaped, the lint filter having an inner surface configured to act as a collecting surface for the lint and wherein a predetermined gap is formed between an inner diameter of the inner surface of the lint filter and an outer diameter of the blade of the rotatable screw; and a plate-shaped contact rib extending in an axial direction of the lint filter, the plate-shaped contact rib having a main surface perpendicular to the axial direction of the lint filter and an edge parallel to the axial direction of the lint filter configured to be in contact with at least a portion of the elastic member installed at the outer edge of the blade, wherein the elastic member is installed on the blade to protrude radially into the gap and configured to contact the inner surface of the lint filter and an edge of the plate-shaped contact rib.

22. A lint removing device configured to remove lint from air flowing out from an exhaust vent of a dryer, the lint removing device comprising:

a frame;

a lint filter having a cylindrical shape of which a part of an outer surface is open;

a screw formed lengthwise in the frame and disposed within the lint filter, the screw including a rotating shaft, a blade having a spiral shape, and an elastic member installed at an outer edge of the blade of the screw; and a plate-shaped contact rib extending in an axial direction of the lint filter, the plate-shaped contact rib having a main surface perpendicular to the axial direction of the lint filter and an edge parallel to the axial direction of the lint filter configured to be in contact with at least a portion of the elastic member installed on an outer edge of the blade, wherein the elastic member is configured to maintain contact with an inner circumference of the lint filter and the edge of the plate-shaped contact rib.

23. The lint removing device of claim 22, wherein a height of the elastic member is controlled to maintain the contact with the inner circumference of the lint filter.

24. The lint removing device of claim 22, further comprising an installation part, wherein the installation part is installed at an outer edge of the blade over an entire circumference along the spiral shape of the blade, and the elastic member is fitted onto the installation part, and thus attached to the outer edge of the blade.

25. The lint removing device of claim 24, wherein an outer edge of the blade is maintained in contact with an inner circumferential surface of the lint filter.

26. The lint removing device of claim 22, wherein the plate-shaped contact rib is formed at an opening side of the lint filter.

* * * * *